US009500066B2

(12) United States Patent
Acosta et al.

(10) Patent No.: US 9,500,066 B2
(45) Date of Patent: Nov. 22, 2016

(54) SYSTEM AND METHOD FOR ACTIVATING A DOWN HOLE TOOL

(71) Applicant: Halliburton Energy Services, Inc., Houston, TX (US)

(72) Inventors: Frank V. Acosta, Duncan, OK (US); Nicholas Frederick Budler, Duncan, OK (US); John Roland Key, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 274 days.

(21) Appl. No.: 14/246,481

(22) Filed: Apr. 7, 2014

(65) Prior Publication Data

US 2014/0216762 A1 Aug. 7, 2014

Related U.S. Application Data

(63) Continuation of application No. 13/664,793, filed on Oct. 31, 2012, now Pat. No. 9,243,480.

(51) Int. Cl.

| | |
|---|---|
| ***E21B 23/00*** | (2006.01) |
| ***E21B 43/12*** | (2006.01) |
| ***E21B 34/14*** | (2006.01) |
| ***E21B 23/06*** | (2006.01) |
| ***E21B 33/128*** | (2006.01) |
| *E21B 34/00* | (2006.01) |

(52) U.S. Cl.

CPC ..... *E21B 43/12* (2013.01); *E21B 23/00* (2013.01); *E21B 23/06* (2013.01); *E21B 33/1285* (2013.01); *E21B 34/14* (2013.01); *E21B 2034/007* (2013.01)

(58) Field of Classification Search

CPC ..... E21B 23/06; E21B 23/08; E21B 23/10; E21B 34/14; E21B 34/103; E21B 43/12; E21B 2034/007

See application file for complete search history.

(56) References Cited

U.S. PATENT DOCUMENTS

| | | | | |
|---|---|---|---|---|
| 3,044,553 | A | 7/1962 | Bradley | |
| 3,524,503 | A | 8/1970 | Baker | |
| 3,730,267 | A * | 5/1973 | Scott | E21B 34/14 166/154 |
| 3,768,556 | A * | 10/1973 | Baker | E21B 33/146 166/154 |
| 3,948,322 | A | 4/1976 | Baker | |
| 5,279,370 | A | 1/1994 | Brandell et al. | |
| 5,375,662 | A | 12/1994 | Echols, III et al. | |
| 5,911,277 | A | 6/1999 | Hromas et al. | |
| 9,243,480 | B2 | 1/2016 | Acosta et al. | |

(Continued)

FOREIGN PATENT DOCUMENTS

WO 2014070665 A1 5/2014

OTHER PUBLICATIONS

Official Action for Singapore Patent Application No. 11201501673V dated Jul. 7, 2015.

*Primary Examiner* — Taras P Bemko

(74) *Attorney, Agent, or Firm* — McDermott Will & Emery LLP; John Wustenberg

(57) ABSTRACT

One disclosed sleeve assembly disposed within a base pipe includes a first sleeve portion having a first shear resistance for resisting movement of the sleeve assembly with respect to the base pipe, and a second sleeve portion moveable with respect the first sleeve portion and having a second shear resistance for resisting movement of the second sleeve portion with respect to the first sleeve portion, the second shear resistance being greater than the first shear resistance.

16 Claims, 4 Drawing Sheets

(56) References Cited

U.S. PATENT DOCUMENTS

| | | | | |
|---|---|---|---|---|
| 2004/0155411 | A1* | 8/2004 | Cargill | F16J 15/062 277/549 |
| 2007/0095573 | A1 | 5/2007 | Telfer | |
| 2010/0032155 | A1 | 2/2010 | Darnell et al. | |
| 2010/0300703 | A1 | 12/2010 | Christie et al. | |
| 2011/0114334 | A1 | 5/2011 | Palacios | |
| 2014/0116732 | A1 | 5/2014 | Acosta et al. | |

* cited by examiner

SYSTEM AND METHOD FOR ACTIVATING A DOWN HOLE TOOL

CROSS-REFERENCE TO RELATED APPLICATIONS

The present application is a continuation of U.S. patent application Ser. No. 13/664,793 filed on Oct. 31, 2012.

BACKGROUND

The present invention relates to systems and methods for activating a down hole tool. More particularly, the present invention relates to systems and methods for setting an annular casing packer with a double-shearing opening sleeve.

In the course of treating and preparing a subterranean well for production, down hole tools, such as well packers, are commonly run into the well on a tubular conveyance such as a work string, casing string, or production tubing. The purpose of the well packer is not only to support the production tubing and other completion equipment, such as sand control assemblies adjacent to a producing formation, but also to seal the annulus between the outside of the tubular conveyance and the inside of the well casing or the wellbore itself. As a result, the movement of fluids through the annulus and past the deployed location of the packer is substantially prevented.

BRIEF DESCRIPTION OF THE DRAWINGS

The following figures are included to illustrate certain aspects of the present invention, and should not be viewed as exclusive embodiments. The subject matter disclosed is capable of considerable modification, alteration, and equivalents in form and function, as will occur to those skilled in the art and having the benefit of this disclosure.

DETAILED DESCRIPTION

The present invention relates to systems and methods for activating a down hole tool. More particularly, the present invention relates to systems and methods for setting an annular casing packer with a double-shearing opening sleeve.

Systems and methods disclosed herein can be configured to activate and/or set a down hole tool. For example, the systems and methods disclosed herein may be particularly well suited for setting an annular casing packer to perform a multi-stage cementing operation. Systems and methods are disclosed that permit the annular packer to be set at a location down hole of a cementer or other down hole tool. In some embodiments, the disclosed systems and methods include a down hole tool that includes a double shear sleeve having a first shearing resistance that, when overcome, allows the sleeve to move from a first position to a second position. Movement of the sleeve from the first position to the second position may, for example, expose a plurality of ports while maintaining a plug in relatively close down hole proximity to the ports. With the ports exposed and the plug in place, the tool may be activated by pressurizing a pressure chamber that is in fluid communication with the ports. In some aspects, activating the tool may include setting a packer element located in an annular space between the tool and the inner surface of the wellbore. After the tool is activated, a second shearing resistance provided in the sleeve can be overcome, which allows a portion of the sleeve and the plug to move down hole such that additional down hole operations can be performed.

Figure 1:
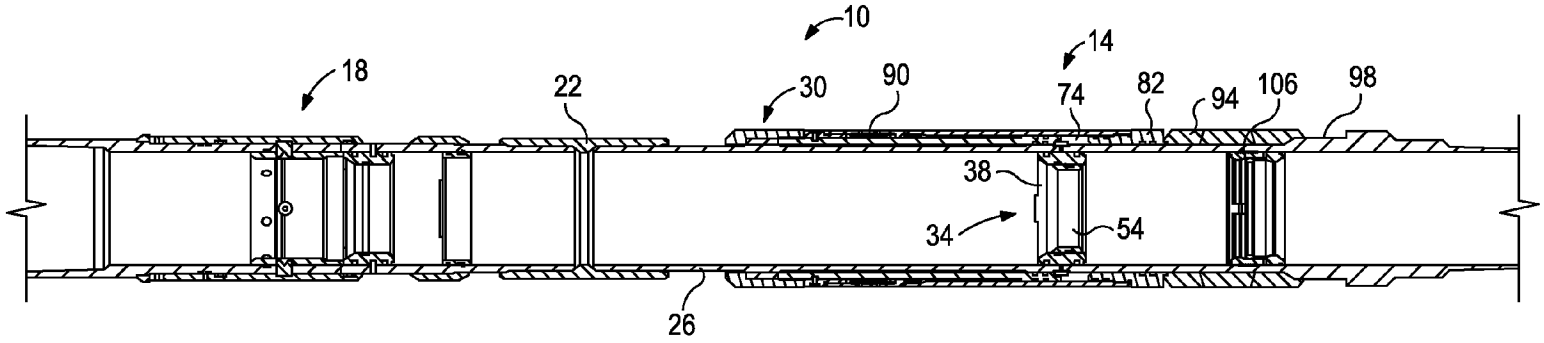
FIG. 1 illustrates a cross-sectional view of a down hole assembly including a cementer in an up hole location and a packer system in a down hole location, according to one or more embodiments disclosed.

Referring to FIG. 1, illustrated is a cross-sectional view of a down hole assembly 10 that includes an exemplary down hole tool in the form of an annular casing packer 14, according to one or more embodiments. In the illustrated configuration, the packer 14 is positioned down hole of a cementer assembly 18, with the packer 14 and the cementer assembly 18 being joined by a coupling 22. In the illustrated construction, the packer 14 is positioned about a base pipe 26 that extends from the coupling 22. The base pipe 26 extends within a wellbore that has been drilled into the Earth's surface to penetrate various earth strata containing, for example, hydrocarbon formations.

It will be appreciated that the packer 14 is not limited to use with any specific type of well, but may be used in all types, such as vertical wells, horizontal wells, multilateral (e.g., slanted) wells, combinations thereof, and the like. As understood by those skilled in the art, an annulus 30 is defined between the exterior of the base pipe 26 and inner wall of the wellbore (not shown). An optional casing (not shown) may line the wellbore and may be made from materials such as metals, plastics, composites, or the like. In some embodiments, the base pipe 26 may be run within another, previously set casing string, thereby providing one or more concentric casing strings with annular spaces therebetween. As discussed further below, by setting the packer 14 and subsequently activating the cementer assembly 18, the annulus 30 of the wellbore up hole of the packer 14 can be cemented. It should be appreciated, however, that the packer 14 can be used in isolation or with substantially any other down hole tool or combination of down hole tools to perform a desired down hole task.

The base pipe 26 may include one or more tubular joints, such as the coupling 22. Such joints may have metal-to-metal threaded connections, welded connections, or other connections generally known to those skilled in the art to form a casing string. In some embodiments, the base pipe 26 may form a portion of a coiled tubing. The base pipe 26 may also be defined in whole or in part by other types of down hole equipment. In this regard, the base pipe 26 may include offset bores, and/or sidepockets, and may include portions formed of a non-uniform construction, such as a joint of tubing having compartments, cavities or other components therein or thereon. Examples of various components that may form portions of the base pipe can include, without limitation, a joint casing, a coupling, a lower shoe, a crossover component, or any other component known to those skilled in the art.

Figure 2:
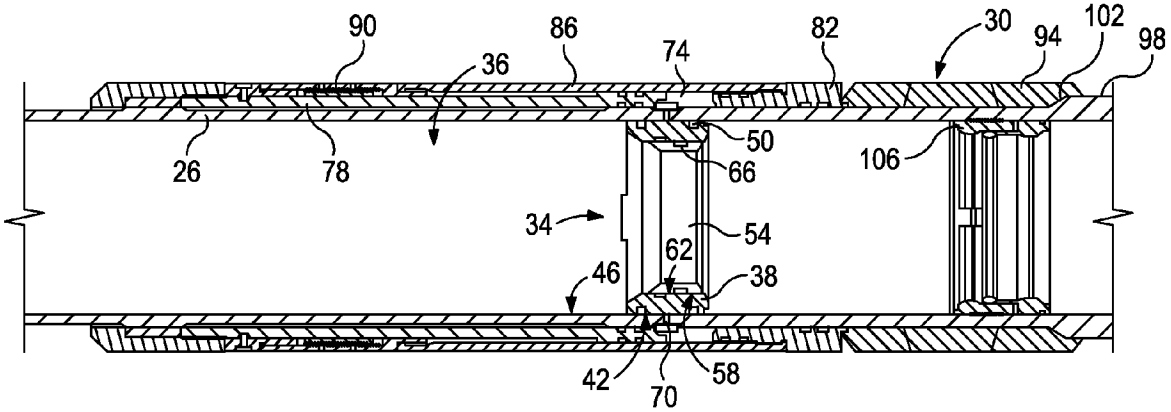
FIG. 2 is an enlarged cross-sectional view of the packer system shown in FIG. 1 in an unactivated position.

Referring to FIG. 2, illustrated is cross-sectional view of an enlarged portion of the down hole assembly 10. In particular, illustrated is a first embodiment of a double-shearing activation sleeve assembly 34 positioned within an interior 36 of the base pipe 26, according to one or more embodiments. The activation sleeve assembly 34 may include a substantially annular outer first portion 38 having a substantially cylindrical first portion outer surface 42 that faces a substantially cylindrical base pipe inner surface 46. A first shearing assembly in the form of a pair of seals 50 may be positioned between the first portion outer surface 42 and the base pipe inner surface 46 to releasably couple the sleeve assembly 34 to the base pipe 26.

In the illustrated configuration, the seals 50 are carried by the first portion 38 and may be configured to frictionally engage the base pipe inner surface 46. In other configurations, one or both of the seals 50 may be fixed with respect to the base pipe 26 and may frictionally engage the first portion outer surface 42. In still other configurations, one or both of the seals 50 may be supplemented or replaced by one or more shear pins, a shear lip, or other force-sensitive releasable securement elements known to those skilled in the art. Regardless of the specific configuration, the first shearing assembly may be configured to provide a first shear resistance that prevents substantial movement of the sleeve assembly 34 with respect to the base pipe 26 until a sufficiently large axial force is applied to the sleeve assembly 34, at which point the first shearing assembly may release the sleeve assembly 34 for movement with respect to the base pipe 26.

The activation sleeve assembly 34 may also include a substantially annular inner second portion 54 coupled to the first portion 38. The second portion 54 may include a second portion outer surface 58 that faces a first portion inner surface 62. A second shearing assembly in the form of at least one seal 66 may be positioned between the second portion outer surface 58 and the first portion inner surface 62 to releasably couple the second portion 54 to the first portion 38. In the illustrated configuration, the at least one seal 66 is carried by the second portion 54 and frictionally engages the first portion inner surface 62. In other configurations, the at least one seal 66 may be fixed with respect to the first portion 38 and may frictionally engage the second portion outer surface 58. In still other configurations, the at least one seal 66 may be supplemented or replaced by one or more shear pins, a shear lip, or other force-sensitive releasable securement elements known to those skilled in the art. Regardless of the specific configuration, the second shearing assembly may be configured to provide a second shear resistance that prevents substantial movement of the second portion 54 with respect to the first portion 38 until a sufficiently large axial force is applied to the second portion 54, at which point the second shearing assembly may release the second portion 54 for movement with respect to the first portion 38. In at least one embodiment, the second shear resistance may be greater than the first shear resistance provided by the first shearing assembly.

The sleeve assembly 34, including the first portion 38 and the second portion 54, can be formed of one or more suitable materials such as, without limitation, aluminum, composites, phenolics, and the like. In this regard, the first portion 38 and the second portion 54 can be formed of the same material or of different materials, without departing from the scope of the disclosure.

With continued reference to FIG. 2, the sleeve assembly 34 is shown in a first position in which the sleeve assembly 34, and more specifically the first portion outer surface 42, overlies and substantially blocks a plurality of ports 70 defined by, for example, the base pipe 26. The ports 70 may be in fluid communication with a pressure chamber 74 positioned on an exterior of the base pipe 26. Thus, when the sleeve assembly 34 is in the first position, the sleeve assembly 34 may function to prevent substantial fluid communication between the interior 36 of the base pipe 26 and the pressure chamber 74.

In the illustrated configuration, the pressure chamber 74 is defined on one end by a substantially fixed inner sleeve 78 and on an opposite end by a moveable piston 82. An outer sleeve 86 that is coupled to and moveable with the piston 82 extends from the piston 82 and over the inner sleeve 78. Other or additional configurations and arrangements of components, ports, and passageways may also be provided to define the pressure chamber 74 and/or to provide fluid communication between the interior 36 of the base pipe 26 and the pressure chamber 74 after the sleeve assembly 34 moves from the first position to the second position. Pressurization of the pressure chamber 74 may be configured to cause the piston 82 to move, for example to the right in FIGS. 1 and 2. A latch or ratchet assembly 90 can be coupled to an end of the outer sleeve 86 opposite the piston 82 and can be configured to permit substantially one-way movement of the piston 82 from the unactivated position shown in FIG. 2 toward an activated position described below.

The piston 82 may be configured to engage a moveable packing element 94 that is expandable to engage the inner wall of the wellbore or casing within which the base pipe may be positioned 26. Upon expansion, the packing element 94 functions to substantially isolate portions of the annulus 30 that are up hole of the packing element 94 from portions of the annulus 30 that are down hole of the packing element 94. Although a variety of packing element configurations may be used without departing from the scope of the present invention, in at least one embodiment a multi-durometer packing element 94 may be employed. The packing element 94 may be expandable by moving the packing element 94 axially onto an enlarged-diameter portion 98 of the base pipe 26. As shown, the base pipe 26 includes or otherwise defines an inclined cam surface 102 configured to expand the packing element 94 radially outward as the packing element 94 is moved axially toward the enlarged diameter portion 98. As discussed further below, movement of the piston 82 in response to pressurization of the pressure chamber 74 may be configured to urge the packing element 94 over the inclined cam surface 102 and onto the enlarged diameter portion 98.

The packer 14 may also include a stop member 106 fixed with respect to the base pipe 26 and axially spaced from the ports 70 in the down hole direction. In the illustrated configuration, the stop member 106 may be a substantially annular sleeve fixed to the base pipe inner surface 46. In other configurations, the stop member 106 may include pins, ridges, or the like. The stop member 106 may be configured to have an effective inner diameter that is smaller than an outer diameter of the first portion 38 of the sleeve assembly 34 but larger than an outer diameter of the second portion 54. In this way, the stop member 106 can limit down hole movement of the first portion 38 of the sleeve assembly 34 after the first shearing assembly has been overcome while permitting down hole movement of the second portion 54 of the sleeve assembly 34 after the second shearing assembly has been overcome.

Figure 3:
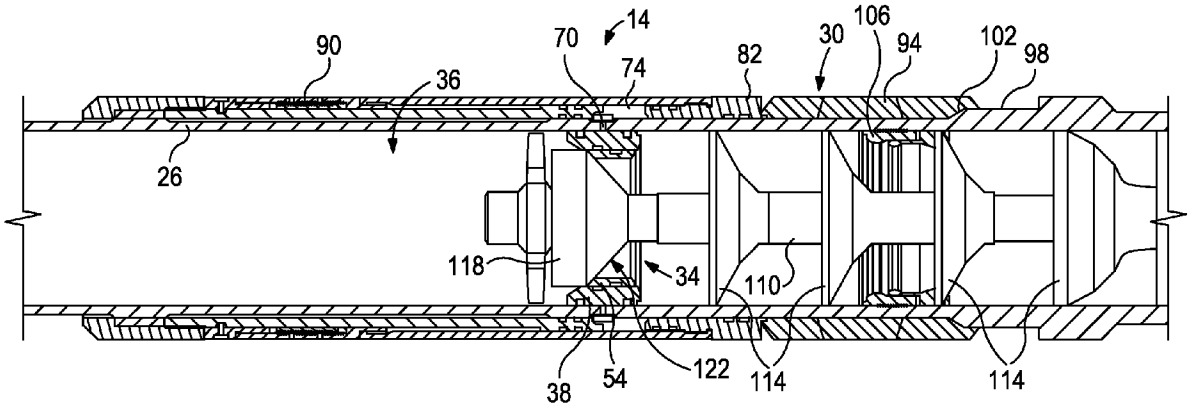
FIG. 3 is a cross-sectional view similar to FIG. 2 showing a plug seated on a double-shearing activation sleeve assembly.

Referring now to FIG. 3, a plug 110 is shown seated against the second portion 54 of the sleeve assembly 34. As understood by those skilled in the art, the plug 110 can be sent down the wellbore until it engages and becomes seated or landed upon the sleeve assembly 34. In the illustrated configuration, a down hole end of the plug 110 includes a plurality of resilient wiper members 114 that can flex to move beyond the sleeve assembly 34, the stop member 106, and other generally annular obstructions encountered as the plug 110 moves along the wellbore.

An up hole end of the plug 110 may include an engagement member 118 that, in the illustrated configuration, includes a substantially frusto-conical engagement surface 122 configured to seat against the second portion 54 of the sleeve assembly 34. When the engagement member 118 seats against or otherwise lands upon the second portion 54 of the sleeve assembly 34, it may be configured to form a plug or seal in the base pipe 26 that prevents substantial fluid movement in the down hole direction beyond the engagement member 118, thus allowing for pressurization of the interior 36 of the base pipe 26 up hole of the plug 110. The engagement member 118 includes an outer diameter that is less than the inner diameter of the first portion 38 of the sleeve assembly 34.

Figure 4:
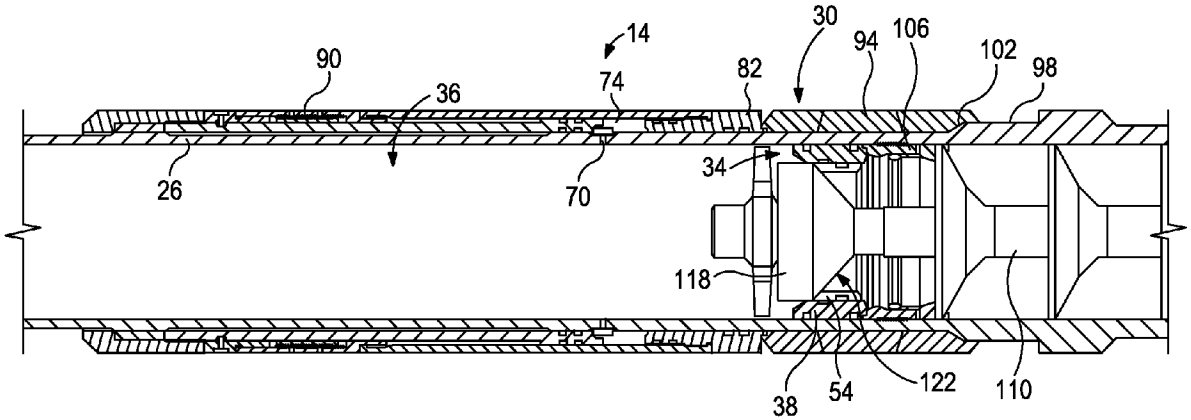
FIG. 4 is a cross-sectional view similar to FIGS. 2 and 3 showing the packer system after a first shearing of the activation sleeve assembly.

Referring now to FIG. 4, with the plug 110 seated against the sleeve assembly 34, the interior 36 of the base pipe 26 up hole of the plug 110 can be pressurized to a first value using, for example, compression or pumping equipment located at the surface. Pressurizing the interior 36 creates an axial force that urges the plug 110 and the sleeve assembly 34 in the down hole direction. When the pressure in the interior 36 is increased by a sufficient amount, the axial force may overcome the first shearing assembly (e.g., the seals 50) between the first portion 38 and the base pipe 26, thereby permitting axial movement of the sleeve assembly 34 with respect to the base pipe 26 from the first position shown in FIG. 3 to the second position shown in FIG. 4. Even though the plug 110 is engaged with the second portion 54 of the sleeve assembly 34, because the second shear resistance is greater than the first shear resistance, the first shearing assembly releases first and the entire sleeve assembly 34 and the plug 110 may be configured to move axially with respect to the base pipe 26. The sleeve assembly 34 and the plug 110 may move axially with respect to the base pipe 26 until the first portion 38 contacts the stop member 106, which serves to limit further axial movement of the sleeve assembly 34.

Figure 5:
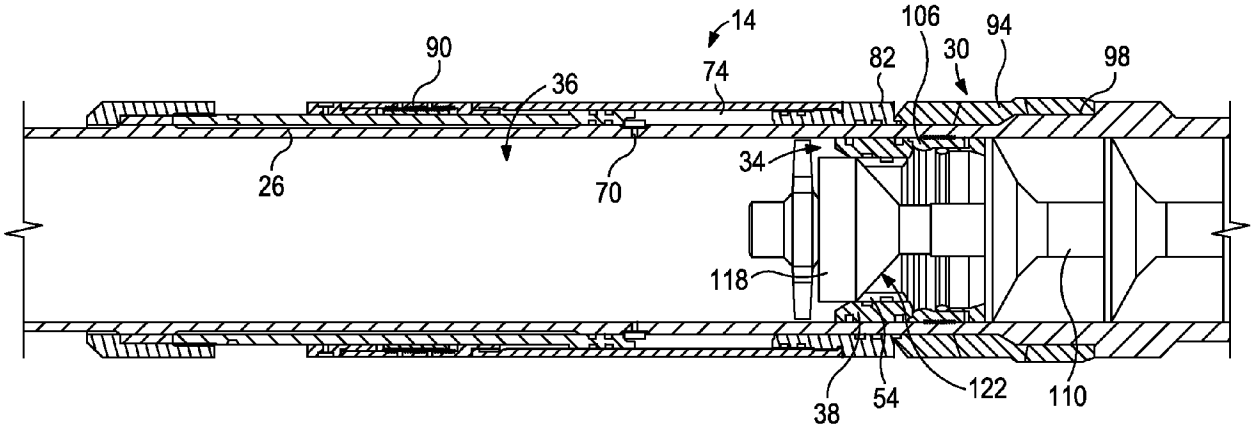
FIG. 5 is a cross-sectional view similar to FIGS. 2-4 showing the packer in a partially activated position.

Referring now to FIG. 5, with the sleeve assembly 34 and the plug 110 moved to the second position shown in FIG. 4, the ports 70 may become exposed, thereby placing the interior 36 of the base pipe 26 in open fluid communication with the pressure chamber 74. Fluid pressure from the interior 36 may therefore be communicated to and may pressurize the pressure chamber 74. Upon pressurization of the pressure chamber 74, the piston 82 may be urged in the down hole direction from an unactivated position, as shown in FIG. 4, toward an activated position, as shown in FIG. 5. In some configurations, the first value interior pressure associated with overcoming the first shear resistance may be sufficient to pressurize the pressure chamber 74 and move the piston 82. In other configurations, the pressure chamber 74 and the piston 82 may each be configured such that further pressurization of the interior 36 to a second value may be required to initiate movement of the piston 82. Moreover, alternative configurations where the sleeve assembly 34 moves in an up hole direction may also be incorporated without departing from the spirit and scope of the present invention.

In the illustrated configuration, movement of the piston 82 toward the activated position may be configured to push the packing element 94 against the cam surface 102 and onto the enlarged diameter portion 98 of the base pipe 26. As the packing element 94 moves onto the enlarged diameter portion 98 of the base pipe 26, it expands radially outward and engages the inner surface of the wellbore or casing, thereby substantially isolating an up hole portion of the annulus 30 from a down hole portion of the annulus 30. As the piston 82 moves in the down hole direction to activate the packer 14, the ratchet assembly 90 may simultaneously operate to prevent the piston 82 from moving back toward the unactivated position.

Figure 6:
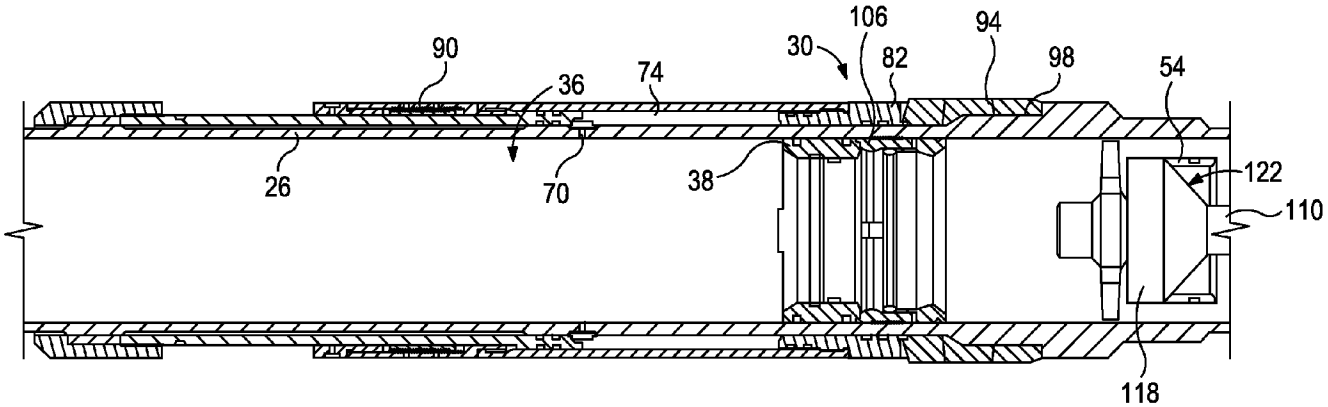
FIG. 6 is a cross-sectional view similar to FIGS. 2-5 showing the packer in the fully activated position and after a second shearing of the activation sleeve assembly.

Referring to FIG. 6, once the piston 82 and the packing element 94 reach the fully activated position, and with the first portion 38 of the sleeve assembly 34 seated against the stop member 106, the interior 36 can be further pressurized, to a value greater than the first value required to overcome the first shearing assembly. More specifically the interior 36 may be further pressurized until an axial force against the plug 110 and the second portion 54 of the sleeve assembly 34 is sufficient to overcome the second shearing assembly, thereby releasing the second portion 54 and the plug 110 from the first portion 38 and allowing the second portion 54 and the plug 110 to move in the down hole direction. Because the inner diameter of the stop member 106 is greater than the outer diameter of both the second portion 54 and the plug 110, once the second shearing assembly is overcome, the second portion 54 and the plug 110 pass through the middle of the stop member 106 and continue moving in the down hole direction until they reach the bottom of the wellbore or some other down hole obstruction.

With the packer 14 set and the plug 110 moved down hole of the assembly 10, the cementer 18 (FIG. 1) can be operated to cement the portion of the annulus 30 that is isolated by the packing element 94. Of course, the cementer 18 is but one example of a down hole tool that can be used with the packer 14. The packer 14 can also be used as a standalone device or with other multistage tools for performing any variety of down hole tasks known to those skilled in the art.

Figure 7:
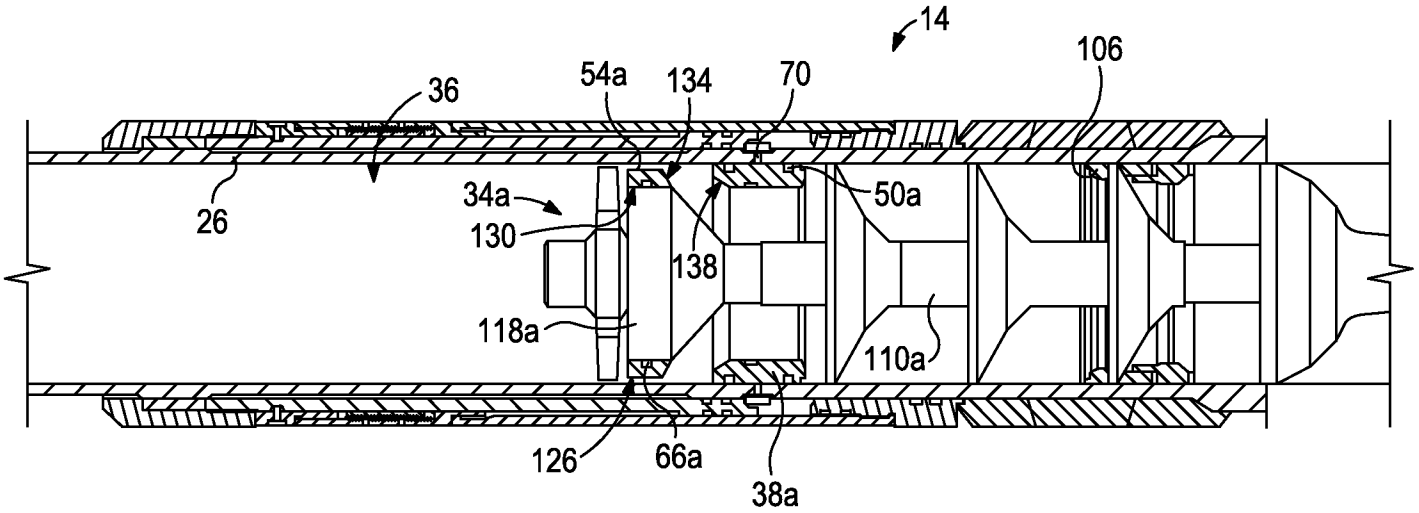
FIG. 7 is a cross-sectional view similar to FIG. 3 showing an alternative embodiment of the double-shearing activation sleeve assembly.

Referring now to FIG. 7, there is shown an alternative embodiment of the double-shearing activation sleeve assembly **34*a* in which plug 110*a* may form part of the activation sleeve assembly 34*a*. The alternative embodiment of the sleeve assembly 34*a* may function in a manner substantially similar to that of the sleeve assembly 34. Unlike the sleeve assembly 34, however, in which the second portion 54 is releasably coupled to the first portion 38, the second portion 54*a* in the sleeve assembly 34*a* may alternatively be releasably coupled to the engagement member 118*a* of the plug 110*a*. More specifically, both the second portion 54*a* and the second shearing assembly (e.g., seal 66*a*) can be relocated onto the engagement member 118*a* and can be moveable with the plug 110*a* through the interior of the base pipe 26. In this regard, the second shearing assembly can be located between an outer surface 126 of the engagement member 118*a* and an inner surface 130 of the second portion 54*a* such that overcoming the second shearing assembly may be configured to release the plug 110*a* for movement with respect to the second portion 54*a***.

The second portion **54*a* may be sized and configured to move with the plug 110*a* in the down hole direction until an engagement surface 134 provided on the second portion 54*a* engages a corresponding engagement surface 138 provided on the first portion 38*a*. The second portion 54*a* includes an outer diameter that is greater than an inner diameter of the first portion 38*a***, such that, when the engagement surface 134 engages the engagement surface 138, down hole movement of the second portion 54*a* may cause down hole movement of the first portion 38*a*. With the second portion 54*a* engaged with the first portion 38*a*, the interior 36 of the base pipe 26 can be pressurized to a first value pressure until the axial force applied to the plug 110*a* overcomes the first shearing assembly (e.g., the seals 50*a*) between the first portion 38*a* and the base pipe 26, thereby permitting axial movement of the sleeve assembly 34*a*, including the first portion 38*a*, the second portion 54*a*, and the plug 110*a*, with respect to the base pipe 26.

The sleeve assembly 34*a*, including the first portion 38*a*, the second portion 54*a*, and the plug 110*a*, moves in the down hole direction until the first portion 38*a* contacts the stop member 106. Movement of the sleeve assembly 34*a* may be configured to open the ports 70 to permit activation of the down hole tool (e.g., setting of the packer 14), as generally discussed above. After activation of the down hole tool, the interior 36 can be further pressurized, to a value greater than the first value pressure required to overcome the first shearing assembly. More specifically the interior 36 may be further pressurized until an axial force against the plug 110*a* is sufficient to overcome the second shearing assembly (e.g. the seal 66*a*), thereby releasing the plug 110*a* from the first portion 38*a* and allowing the plug 110*a* to move in the down hole direction.

In the alternative embodiment of FIG. 7, the inner diameter of the stop member 106 may be greater than the outer diameter of the plug 110*a*, but may be less than the outer diameter of the first portion 38*a*. As with the previously described embodiment, once the second shearing assembly is overcome, the plug 110*a* may be configured to pass through the middle of the stop member 106 and continue moving in the down hole direction until it reaches the bottom of the wellbore or some other down hole obstruction, at which point the cementer 18 (FIG. 1) can be operated to cement the portion of the annulus 30 that is isolated by the packing element 94.

Although a particular design of the plugs 110, 110*a* are shown in the illustrated configurations, other known down hole components such as balls, darts, and the like may also be used and configured to engage and move the sleeve assembly 34 in accordance with the above teachings. The plugs 110, 110*a* and other down hole components can be fabricated using one or more of aluminum, composites, rubber, and the like, without limitation.

In the foregoing description of the representative embodiments of the invention, directional terms, such as "above", "below", "upper", "lower", etc., are used for convenience in referring to the accompanying drawings. In general, "above", "upper", "upward", "up hole" and similar terms refer to a direction toward the earth's surface along a wellbore, and "below", "lower", "downward", "down hole" and similar terms refer to a direction away from the earth's surface along the wellbore.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended due to the details of construction or design herein shown, other than as described in the claims below. It is therefore evident that the particular illustrative embodiments disclosed above may be altered, combined, or modified and all such variations are considered within the scope and spirit of the present invention. In addition, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

What is claimed is:

1. A sleeve assembly disposed within a base pipe, comprising:

a first sleeve portion having a first shear resistance for resisting movement of the sleeve assembly with respect to the base pipe;

a second sleeve portion moveable with respect the first sleeve portion and having a second shear resistance for resisting movement of the second sleeve portion with respect to the first sleeve portion, the second shear resistance being greater than the first shear resistance;

a first shear assembly positioned entirely between an outer surface of the first sleeve portion and an inner surface of the base pipe to provide the first shear resistance; and a second shear assembly positioned entirely between an outer surface of the second sleeve portion and an inner surface of the first sleeve portion to provide the second shear resistance; and a plug engageable with the second sleeve to plug an interior of the base pipe, wherein hydraulic pressure at a first pressure within the base pipe acts directly on the plug and results in a first axial load assumed by the first sleeve portion that is greater than the first shear resistance, and wherein hydraulic pressure at a second pressure greater than the first pressure within the base pipe acts directly on the plug and results in a second axial load assumed by the second sleeve portion that is greater than the second shear resistance.

2. The sleeve assembly of claim 1, wherein the first sleeve portion is an outer annular portion opposable with an inner surface of the base pipe, and wherein the second sleeve portion is an inner annular portion nested within the first sleeve portion.

3. The sleeve assembly of claim 2, wherein one or both of the first and second shear assemblies are entirely composed of one or more seals.

4. The sleeve assembly of claim 1, wherein the plug provides an engagement member that exhibits a plug outer diameter that is less than an inner diameter of the first sleeve portion but greater than an inner diameter of the second sleeve portion.

5. The sleeve assembly of claim 4, wherein upon assuming the first axial load, the first sleeve portion is moved from a first position, where the first sleeve portion occludes a plurality of ports defined in the base pipe, and a second position, where the first sleeve portion has moved axially within the base pipe to expose the plurality of ports.

6. The sleeve assembly of claim 5, wherein upon assuming the second axial load, the second sleeve portion is moved axially out of engagement with the first sleeve portion.

7. The sleeve assembly of claim 1, wherein the plug is at least one of a plug, a dart, and a ball.

8. The sleeve assembly of claim 1, wherein the plug is made of a material selected from the group consisting of aluminum, a composite, rubber, and any combination thereof.

9. The sleeve assembly of claim 1, wherein the first and second sleeve portions are made of a material selected from the group consisting of aluminum, a composite, phenolics, and any combination thereof.

10. The sleeve assembly of claim 1, wherein the plug comprises a wellbore dart that includes a plurality of wiper members at a downhole end of the plug that flex to traverse the first and second sleeves.

11. A method of manipulating a sleeve assembly disposed within a base pipe, comprising:

introducing a plug into the base pipe and conveying the plug toward the sleeve assembly, the sleeve assembly including a first sleeve portion and a second sleeve portion nested within the first sleeve portion;

landing the plug on the second sleeve and thereby plugging an interior of the base pipe;

increasing a hydraulic pressure within the base pipe to a first pressure that acts directly on the plug and results in a first axial load assumed by the first sleeve portion;

resisting movement of the first sleeve portion with respect to the base pipe with a first shear resistance generated by a first shear assembly positioned entirely between an outer surface of the first sleeve portion and an inner surface of the base pipe;

overcoming the first shear resistance with the first axial load;

increasing the hydraulic pressure within the base pipe to a second pressure greater than the first pressure that acts directly on the plug and results in a second axial load assumed by the second sleeve portion;

resisting movement of the second sleeve portion with respect to the first sleeve portion with a second shear resistance generated by a second shear assembly positioned entirely between an outer surface of the second sleeve portion and an inner surface of the first sleeve portion, wherein the second shear resistance is greater than the first shear resistance; and overcoming the second shear resistance with the second axial load.

12. The method of claim 11, wherein at least one of the first and second shear assemblies is entirely composed of one or more seals.

13. The method of claim 11, wherein the plug provides an engagement member that exhibits a plug outer diameter that is less than an inner diameter of the first sleeve portion but greater than an inner diameter of the second sleeve portion, the method further comprising:

assuming the first axial load on the first sleeve portion through engagement with the second sleeve portion via the second shear assembly; and moving the first sleeve portion from a first position, where the first sleeve portion occludes a plurality of ports defined in the base pipe, to a second position, where the first sleeve portion has moved axially to expose the plurality of ports.

14. The method of claim 13, further comprising:

axially moving the second sleeve portion out of engagement with the first sleeve portion upon assuming the second axial load.

15. The sleeve assembly of claim 1, wherein the first shear assembly is disposed about and carried by the outer surface of the first sleeve portion to engage the the inner surface of the base pipe, and wherein the second shear assembly is disposed about and carried by the outer surface of the second sleeve portion to engage the inner surface of the first sleeve portion.

16. The method of claim 11, wherein the plug comprises a wellbore dart that includes a plurality of wiper members at a downhole end of the plug, wherein landing the plug on the second sleeve comprises flexing the plurality of wiper members to traverse the first and second sleeves.

* * * * *